US010857411B2

(12) United States Patent
Nelson

(10) Patent No.: US 10,857,411 B2
(45) Date of Patent: Dec. 8, 2020

(54) ATHLETIC TIRE TRAINING DEVICE AND METHODS

(71) Applicant: THE PROPHET CORPORATION, Owatonna, MN (US)

(72) Inventor: Matthew Allen Nelson, Minneapolis, MN (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 16/503,115

(22) Filed: Jul. 3, 2019

(65) Prior Publication Data

US 2019/0321676 A1 Oct. 24, 2019

Related U.S. Application Data

(63) Continuation of application No. 15/209,071, filed on Jul. 13, 2016, now Pat. No. 10,343,007.

(51) Int. Cl.

| | |
|---|---|
| ***A63B 21/06*** | (2006.01) |
| ***A63B 21/00*** | (2006.01) |
| ***A63B 23/12*** | (2006.01) |

(52) U.S. Cl.

CPC ..... *A63B 21/0601* (2013.01); *A63B 21/0004* (2013.01); *A63B 21/00189* (2013.01); *A63B 21/4035* (2015.10); *A63B 21/4043* (2015.10); *A63B 23/12* (2013.01)

(58) Field of Classification Search

CPC .. A63B 21/072; A63B 21/0724; A63B 21/075
See application file for complete search history.

(56) References Cited

U.S. PATENT DOCUMENTS

| | | | |
|---|---|---|---|
| 4,431,185 | A | 2/1984 | Cisneros |
| 5,076,575 | A | 12/1991 | Eylander |
| 5,383,804 | A | 1/1995 | Mitch et al. |
| D384,720 | S | 10/1997 | Spomer |
| D428,955 | S | 8/2000 | Peterson |
| D429,787 | S | 8/2000 | Peterson |
| 6,123,651 | A | 9/2000 | Ellenburg |
| D432,614 | S | 10/2000 | Peterson |
| D476,712 | S | 7/2003 | Peterson |
| 6,648,707 | B1 | 11/2003 | Peterson |
| 6,702,723 | B2 | 3/2004 | Landfair |
| D506,239 | S | 6/2005 | Peterson |
| D510,971 | S | 10/2005 | Hunter |
| D514,392 | S | 2/2006 | Bruns |
| 7,182,715 | B2 | 2/2007 | Anderson |
| 7,207,929 | B2 | 4/2007 | Hamilton |
| 7,458,920 | B2 | 12/2008 | Hallar |
| D588,975 | S | 3/2009 | Spater et al. |
| 7,517,305 | B2 | 4/2009 | Lien |
| 7,678,028 | B1 | 3/2010 | Gore |
| D632,354 | S | 2/2011 | Perry |
| 8,128,539 | B2 | 3/2012 | Dickerson |
| 8,276,351 | B1 | 10/2012 | Henkin |

(Continued)

*Primary Examiner* — Joshua Lee
(74) *Attorney, Agent, or Firm* — Merchant & Gould P.C.

(57) ABSTRACT

An athletic tire training device includes a compressible body having a flat surfaced top, flat surfaced base, a surrounding wall extending between the top and base, and an interior wall extending between the top and base. The surrounding wall has an exterior surface with flat sides. The interior wall surrounds an open interior volume. The body has a weight of at least 20 pounds. The training device is usable in a variety of functional training exercises.

15 Claims, 18 Drawing Sheets

(56) References Cited

U.S. PATENT DOCUMENTS

| | | | |
|---|---|---|---|
| D672,414 | S | 12/2012 | Januszek |
| D678,447 | S | 3/2013 | Peterson |
| D751,655 | S | 3/2016 | Januszek |
| D800,233 | S | 10/2017 | Januszek |
| D817,429 | S | 5/2018 | Adkisson |
| 10,076,679 | B2 | 9/2018 | Dickerson |
| 2005/0075221 | A1 | 4/2005 | Fond |
| 2005/0187075 | A1 | 8/2005 | Bellamy |
| 2006/0073948 | A1 | 4/2006 | Lincir |
| 2006/0160675 | A1 | 7/2006 | Brown |
| 2006/0172070 | A1 | 8/2006 | Cao |
| 2007/0184943 | A1 | 8/2007 | Davies |
| 2010/0317496 | A1 | 12/2010 | Abranchess |
| 2012/0083396 | A1 | 4/2012 | Aquino |
| 2013/0023388 | A1 | 1/2013 | English |
| 2013/0184129 | A1 | 7/2013 | Lovegrove et al. |
| 2013/0316880 | A1 | 11/2013 | Bosse |
| 2015/0165258 | A1 | 6/2015 | Januszek |
| 2017/0128809 | A1 | 5/2017 | Adkisson |

ATHLETIC TIRE TRAINING DEVICE AND METHODS

TECHNICAL FIELD

The present application is a continuation of U.S. patent application Ser. No. 15/209,071, filed Jul. 13, 2016 which is incorporated herein by reference in its entirety.

TECHNICAL FIELD

This disclosure relates to an athletic tire or exercise device and methods of use.

BACKGROUND

Functional training includes fitness exercises that train muscles to work together and prepare them for daily tasks by simulating common movements that might be done at home, work, or in sports. Functional fitness exercises can also emphasize core stability.

One functional fitness exercise is tire training. Tire training includes deadlifts, tire walks, tire flips, etc.

Disadvantages of tire workouts include that the tires can be dirty, hard to manage in that they roll away, and difficult to neatly store especially in a gym environment. Improvements are desirable.

SUMMARY

An athletic tire training device is provided that improves the prior art.

In general, an athletic tire training device includes a compressible body having a planar or flat surfaced top, a planar or flat surfaced base, a surrounding wall extending between the top and base, and an interior wall extending between the top and base. The surrounding wall has an exterior surface with a plurality of flat sides. The interior wall surrounds an open interior volume. The body has a weight of at least 20 lbs.

The body can have a height between the top and base of at least 12 inches and a width across the surrounding wall of at least 24 inches. The interior volume can have a width of at least 9 inches.

The training device can further include at least one handle.

The at least one handle can be on at least one of the sides.

The at least one handle can be on the flat surfaced top.

The plurality of flat sides can include at least five sides; at least six sides; at least seven sides; and at least eight or more sides.

Each of the flat sides can have a width of at least 6 inches.

At least two or more of the sides may include a first handle adjacent to the top and a second handle adjacent to the base.

In embodiments that have a first handle adjacent to the top and second handle adjacent to the base, some implementations may include each of the first handle and second handle being generally parallel to the top and base.

In some embodiments, alternate sides include the first handle and second handle, and alternate sides are handle-free.

The top may have at least two top handles.

The top handles can be oriented such that an axis in alignment along each of the handles does not intersect the open interior volume.

The top handles can be generally parallel to two of the sides.

In some implementations, the top has at least four handles.

In implementations that have at least four handles, the at least four handles can include a first pair of generally parallel handles with the open interior volume therebetween and a second pair of generally parallel handles with the open interior volume therebetween.

In some embodiments, the base is handle-free.

In some implementations, the interior wall can include a plurality of flat interior sides.

The flat interior sides can be equal in number to a number of flat sides of the surrounding wall.

The training device may further include a cover member covering the body.

The cover member can be a vinyl cover secured by a zipper or other fastener device.

In implementations that include a cover member, the at least one handle is secured to an exterior of the cover member.

In some embodiments, the body consists essentially of a single material.

The body can be made of a compressible material, and consist essential of polyurethane foam blend.

The body may comprise foam.

The body may consist essentially of foam.

The body can have a weight of at least 25 lbs.

The body can have a weight of not greater than 300 lbs.

The top and base can have a radial length between the surrounding wall and the interior volume of at least 6 inches.

In another aspect, a method of using an athletic tire training device includes grasping a compressible body having a flat surfaced top, flat surfaced base, a surrounding wall extending between the top and base, and an interior wall extending between the top and base. The method includes moving the body from a position resting on either the top or base to a position resting on a flat side that forms part of the surrounding wall. The body will weigh at least 20 lbs.

The step of grasping can include grasping a pair of spaced handles projecting from the surrounding wall.

The step of moving the body can include moving the body from either the top or base to a position resting on the other of the top or base.

After the step of moving the body from either the top or base to a position resting on the other of the top or base, the method can include again moving the body to an original position of either the top or base.

The method can further include positioning the body to rest on the top and jumping onto the base, the base being handle-free.

The interior wall can surround an open interior volume, and the method may further include a step of standing in the interior volume and lifting the body.

The step of standing in the interior volume and lifting the body can include grasping handles projecting from the top of the body.

The step of grasping handles projecting from the top of the body may include grasping handles spaced apart by the interior volume and that each has an axis in alignment along each of the handles that does not intersect the open interior volume.

In another aspect, an athletic tire training device is provided. The athletic tire training device includes a compressible body having a flat surfaced top, flat surfaced base, and a surrounding wall extending between the top and base. The surrounding wall has an exterior surface with a plurality of flat sides. The body has a height between the top and base of at least 12 inches and a width across the surrounding wall of at least 24 inches. There is at least one handle secured to the body. The body has a weight of at least 20 lbs.

The athletic tire training device may further include a cover member covering the body.

The at least one handle can be secured to the exterior of the cover member.

The compressible body may consist essentially of a single material.

The single material can include foam.

The body can comprise foam.

The body can have an open center with a size of at least 9 inches.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein and constitute a part of the description, illustrate several aspects of the present disclosure. A brief description of the drawings is as follows.

DETAILED DESCRIPTION

Figure 1:
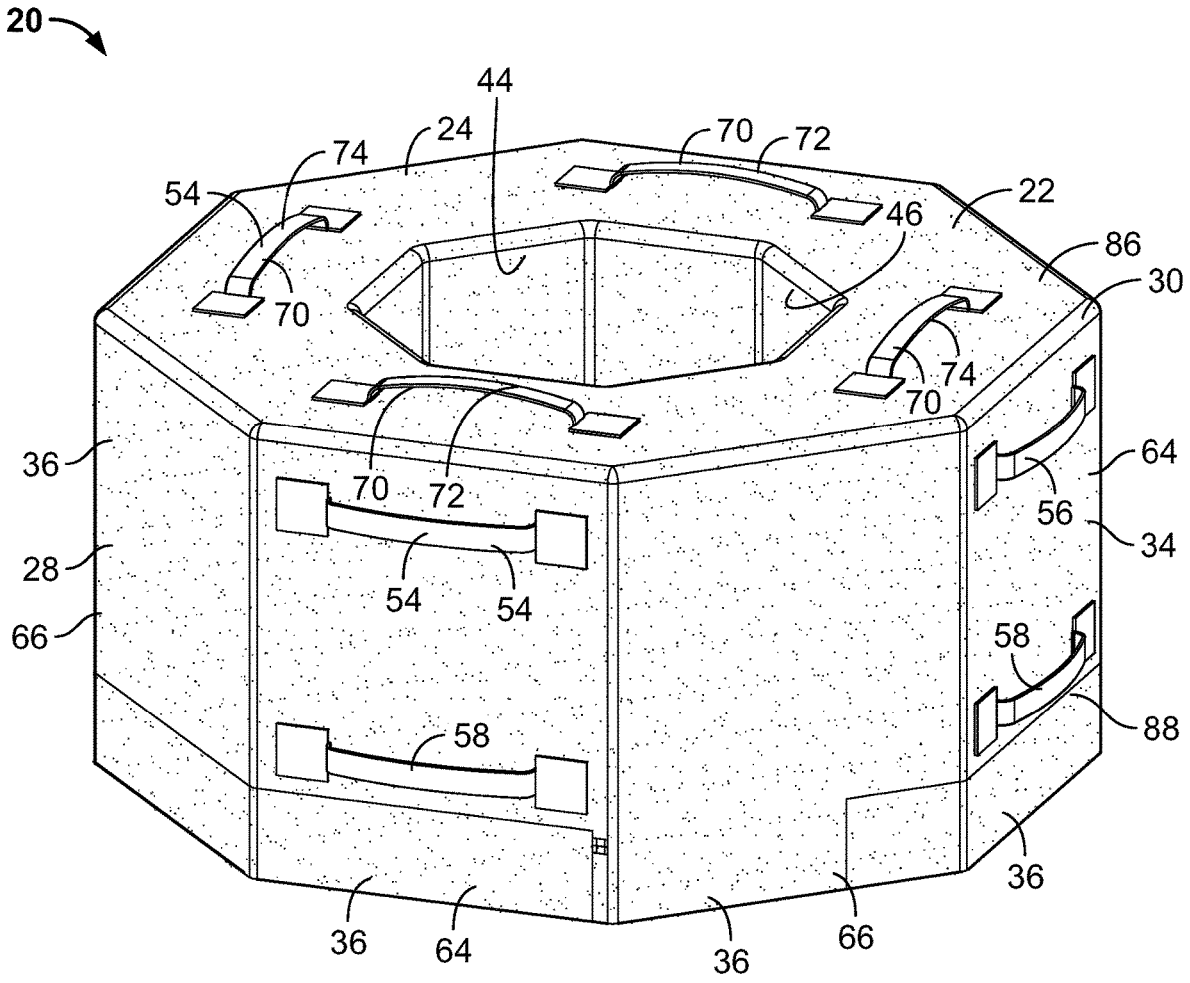
FIG. 1 is a perspective view of one embodiment of an athletic tire training device constructed in accordance with principles of this disclosure.

FIGS. 1-8 depict an athletic tire training device at 20. The training device 20 is usable for functional training and other forms of exercise. Examples of training exercises are depicted in FIGS. 9-18, described further below.

The training device 20 includes a body 22. In general, the body 22 is compressible. The term "compressible", it is meant that there will be deformation (either elastic or inelastic) of the body 22 responsive to normal human force, such as 1 pound or more of pressure. The body 22 is not made from a hard material, such as concrete, a hard plastic, or other materials that do not easily compress. The body 22 is generally soft, but dense enough, to generally support the weight of one or more humans weighing no greater than 1000 pounds.

In general, the body 22 is made from a material, such as foam. The body 22 can comprise foam. In some embodiments, the body 22 consists essentially of a single material, such as foam, polyurethane foam, or rebond polyurethane blended particles. The foam material can include the following properties: rebond polyurethane blend of post-industrial and post-consumer polyurethane scrap and other post-industrial fillers having a density of 6-12.0 lbs/ft$^3$. For example, in constructions with a total weight of greater than 25 lbs, it is convenient to use the foam having a density of about 12.0 lbs/ft$^3$, while in constructions with a total weight of 25 lbs or less, foams having a density of 6.0 lbs/ft$^3$ are convenient.

The body 22 will have a weight that is large enough to provide a suitable challenge to a human for functional training exercises. In many cases, the body 22 will have a weight of at least 20 pounds, for example at least 25 pounds. The body 22 can have a weight greater than 30 pounds, for example such as at least 50 pounds, at least 90 pounds, at least 130 pounds, at least 175 pounds, at least 200 pounds, and not greater than 300 pounds.

The body 22 has a planar or flat surfaced top 24. The flat surfaced top 24 is planar in that it has no projections, other than handles (as described further below) extending therefrom. The planar or flat top 24 provides advantages in that it can be conveniently stacked or stored adjacent to other training devices 20 in a neat and orderly way.

The body 22 includes a base 26. In the embodiment shown, the base 26 is planar or flat. As such, the base 26 is free of protrusions or projections extending therefrom. In preferred implementations, the base 26 is also handle-free. Having a handle-free base 26 is useful for certain training exercises, such as box jumping (FIGS. 11 and 12) and forms of side jumping (FIGS. 15-18). Although in the embodiment shown, the base 26 is handle-free, in other embodiments, the base 26 could have handles. Being handle-free, however, is preferred as it leads to advantages.

When both the top 24 and base 26 are flat, a plurality of the training devices 20 can be stacked, one on top of another in a stable and convenient manner. If the top 24 and base 26 were not flat, stacking the training devices 20 could create a less stable stack and could take up more room.

Figure 6:
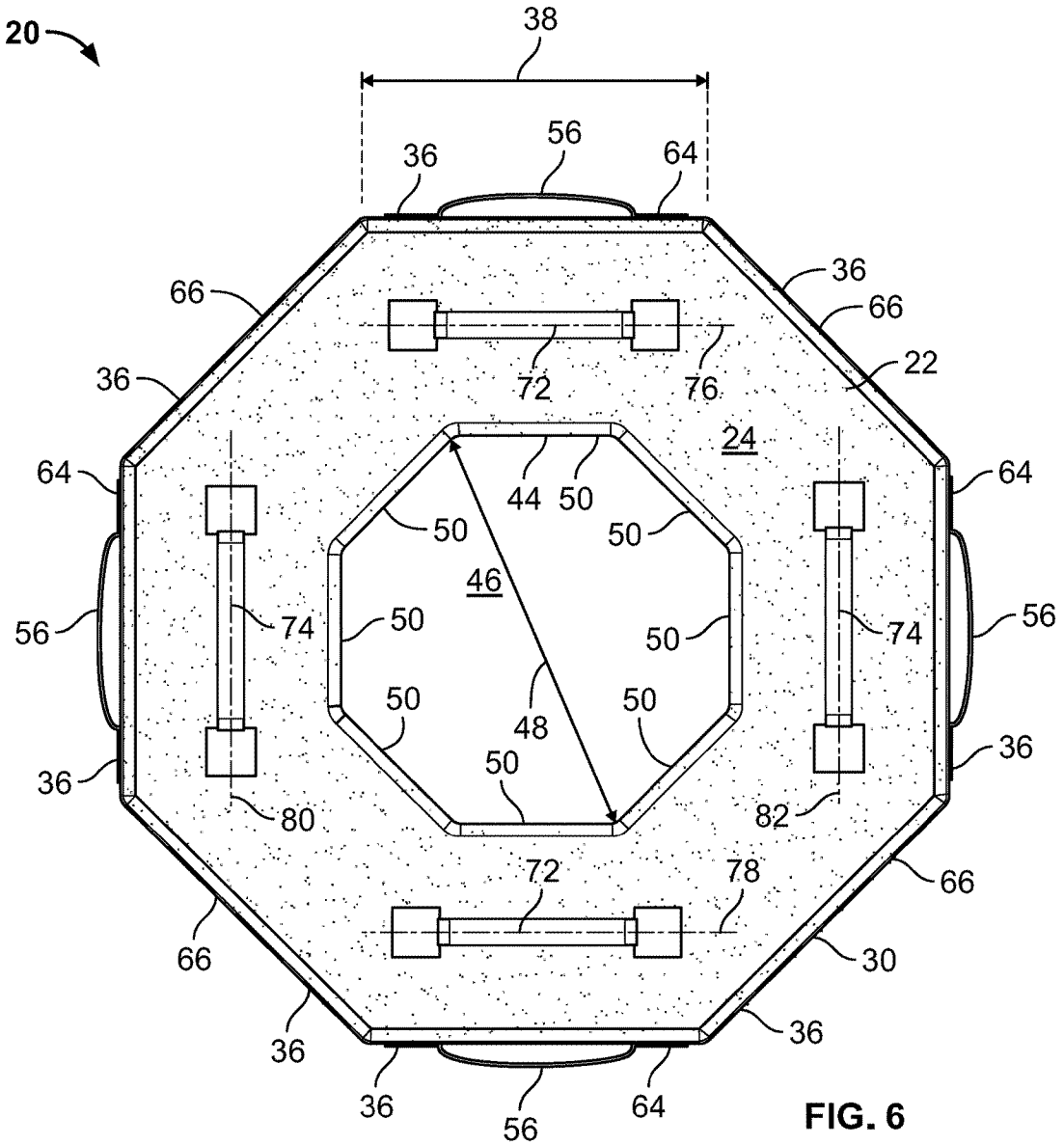
FIG. 6 is a top view of the device of FIG. 1.
Figure 7:
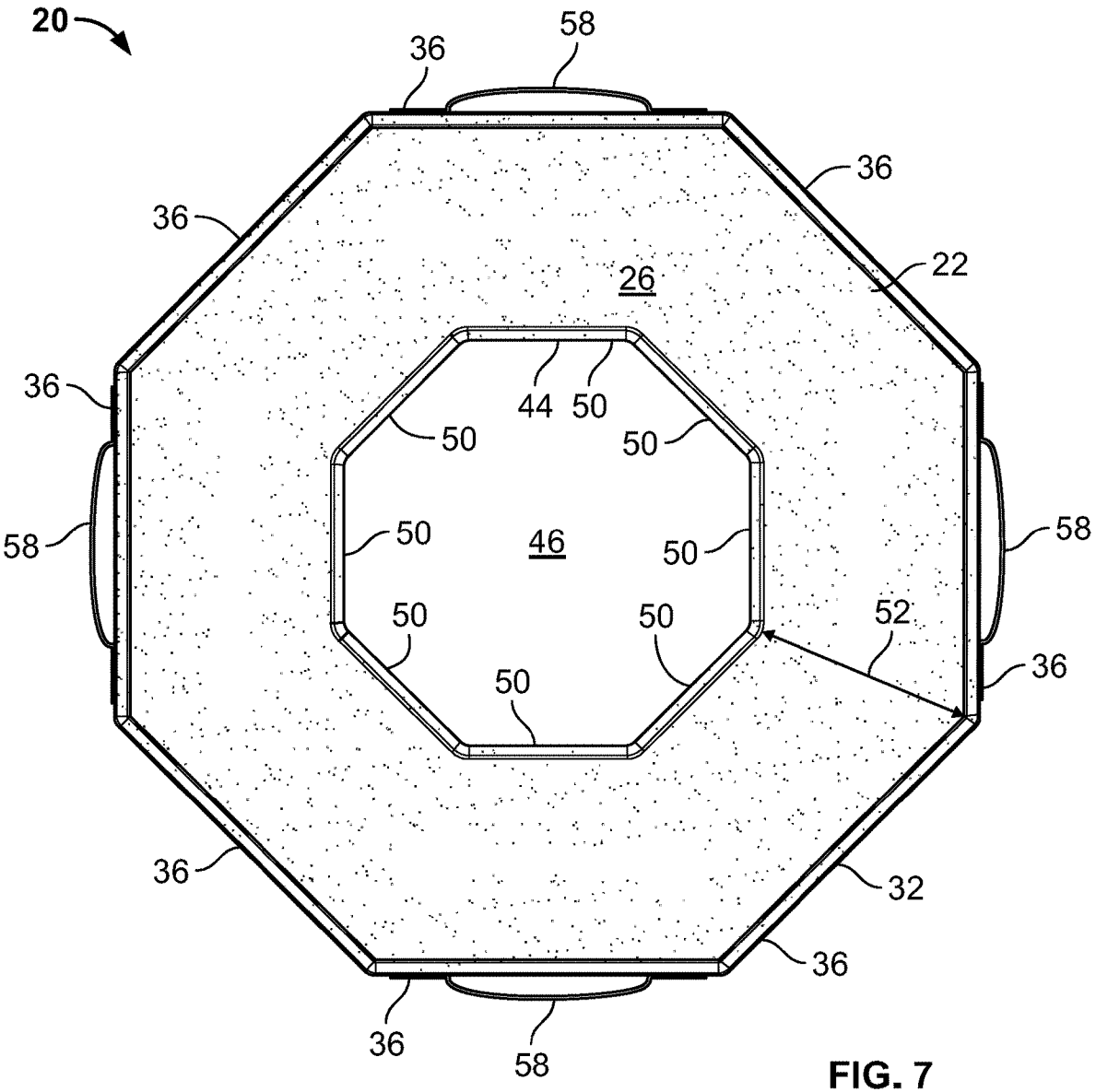
FIG. 7 is a bottom view of the device of FIG. 1.
Figure 8:
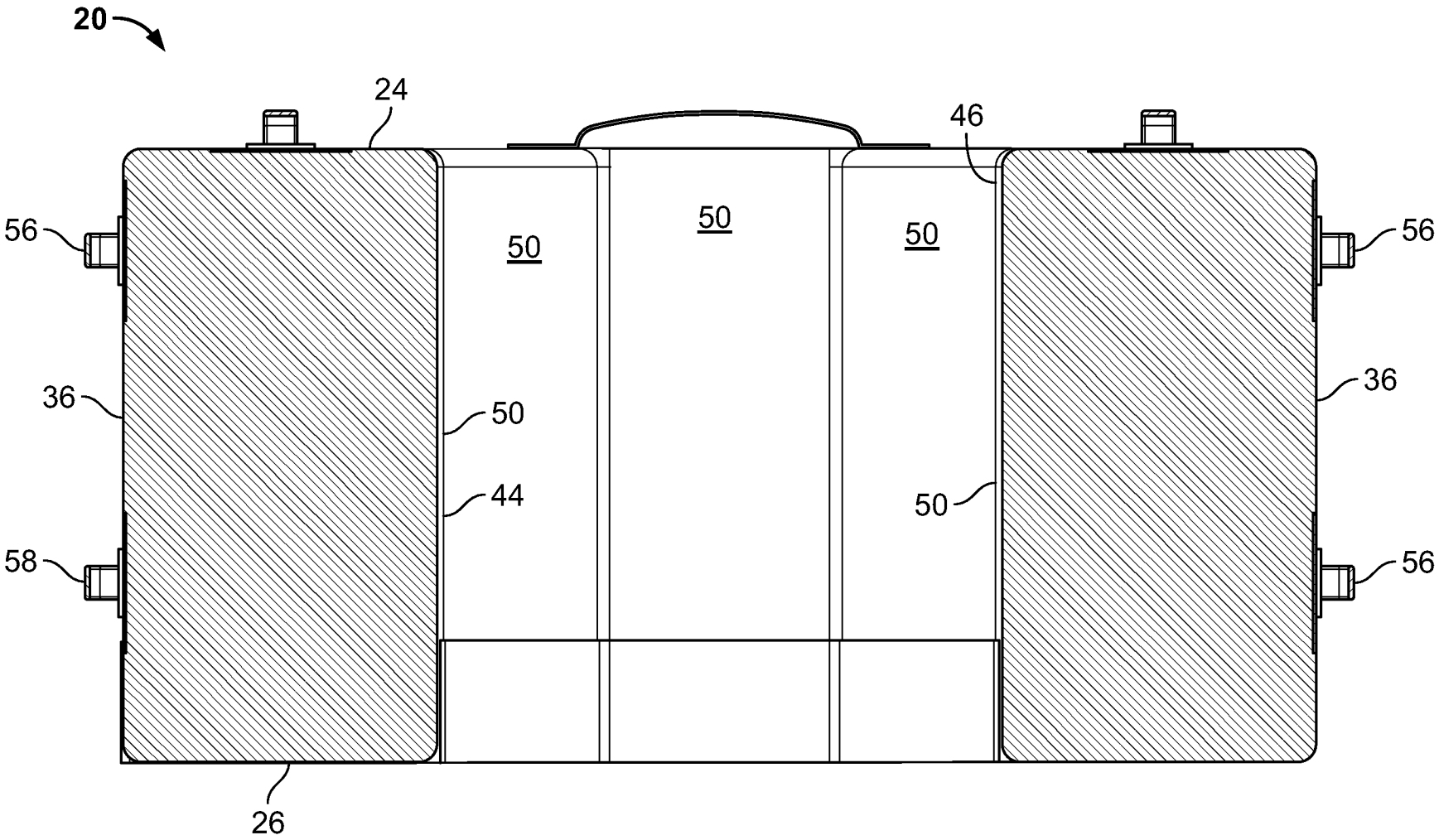
FIG. 8 is a cross-sectional view through the device of FIG. 1.

In accordance with principles of this disclosure, the body 22 includes a surrounding wall 28. The surrounding wall 28 generally extends between the top 24 and the base 26. As can be seen in FIGS. 1, 6, and 7, there can be optional rounded or beveled corners or intersections between the surrounding wall 28 and the top 24 at surface 30 and between the surrounding wall 28 and base 26 at surface 32. These rounded or beveled surfaces 30, 32 can be helpful in preventing injuries due to sharpness at these intersections. Many embodiments are possible.

Figure 9:
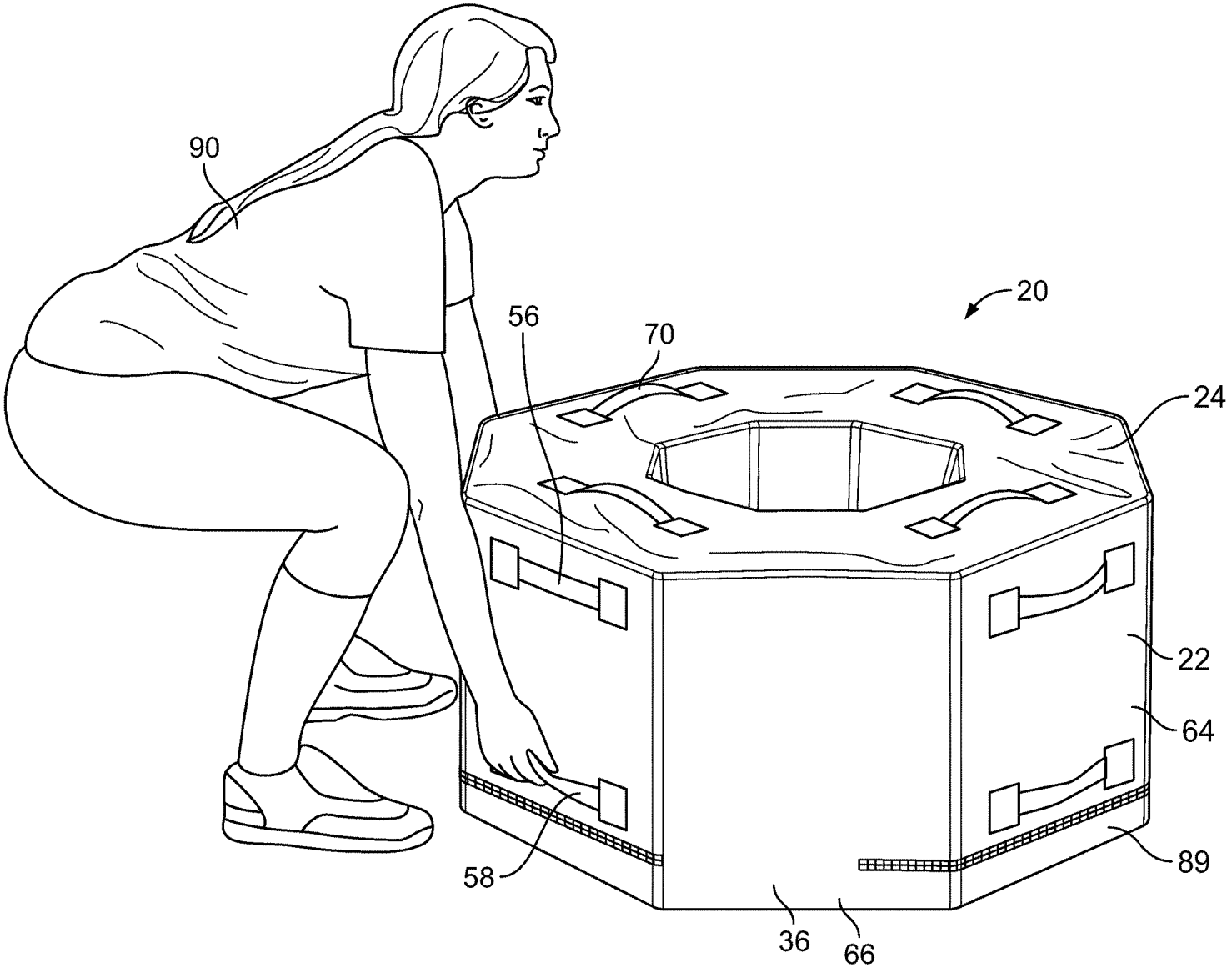
FIGS. 9-18 are perspective views of the device of FIG. 1 being used in various training exercises.
Figure 10:
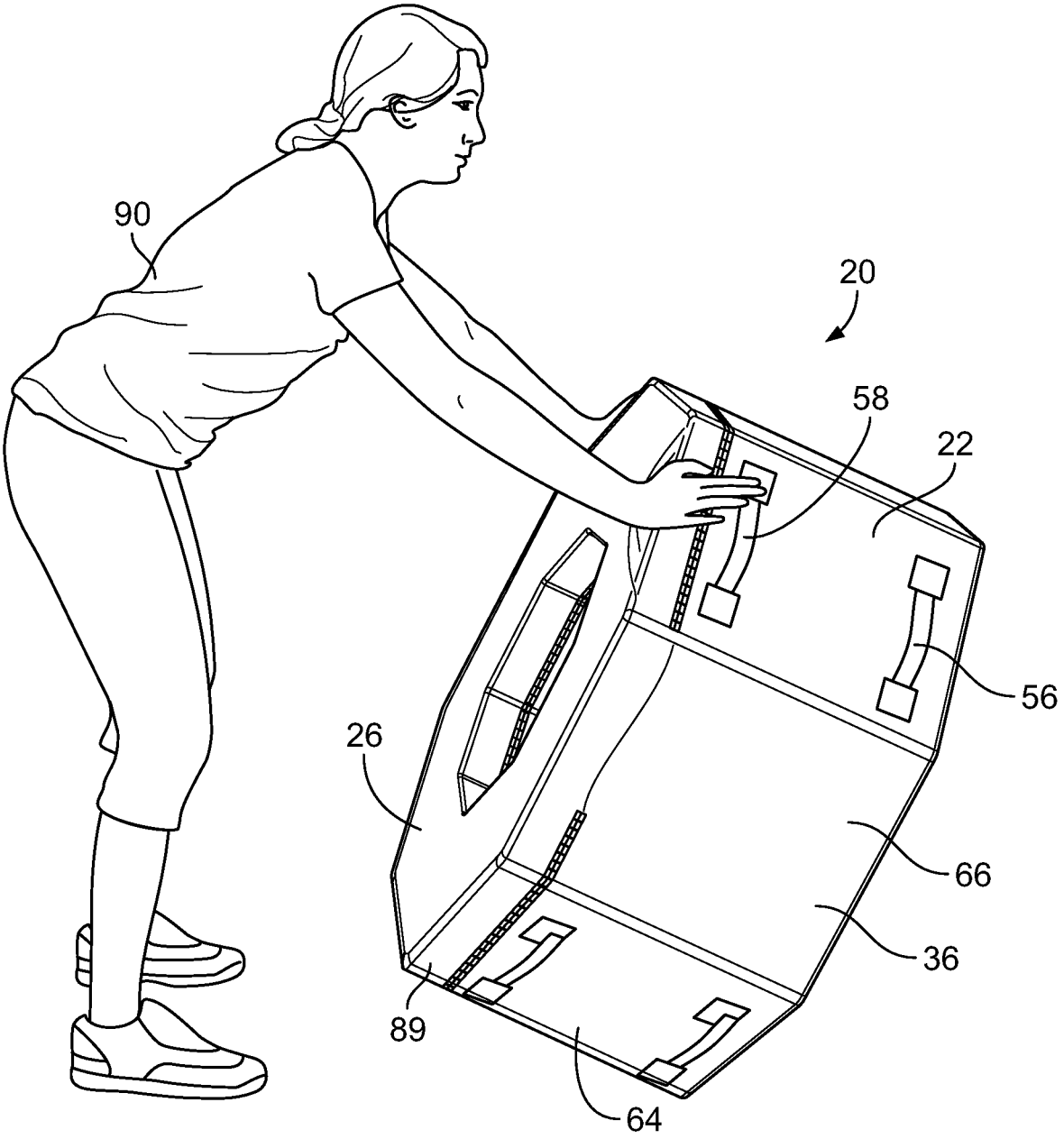

The surrounding wall 28 has an exterior surface 34. The exterior surface 34 includes a plurality of planar or flat sides 36. The planar or flat sides 36 lead to advantages. For example, conventional tires, when used in functional training, do not have flat sides and are round and can roll away. The flat sides 36 lead to stability and do not roll away when being used or in training. In addition, the flat sides 36 allow for stable storage in a gym, when not in use. Again, if the sides were not flat, but round, the storage would not be as stable or convenient as the roundness could lead to the devices rolling away when stored on their sides. The flatness of the sides 36 also allows for stability when used during training, such as during flipping exercises, as illustrated in FIGS. 9 and 10.

The training device 20 can be many different shapes including rectangular, having 4 sides, or any shape of a regular or irregular polygon. For example, there can be at least 5 flat sides 36; at least 6 flat sides 36; at least 7 flat sides 36; or at least 8 flat sides 36. There can be more than 8 flat sides 36. In the particular embodiment illustrated in the drawings, there are 8 flat sides 36. Each of the flat sides 36 is generally the same length, forming a regular octagon shape. Other embodiments can be irregular in shape.

In many embodiments, the flat sides 36 have a width 38 (FIG. 6) of at least 6 inches. The width 38 can be typically 10-20 inches. The width 38 will generally not exceed 30 inches. Convenient widths 38 will be about 10-11 inches, or about 14-15 inches, or about 16-17 inches, or about 19-20 inches in various embodiments. In the embodiment shown, each of the flat sides 36 has the same width 38. It is envisioned that in other embodiments, there could be intermediate flat sides with longer or shorter widths 38.

The body 22 has a height 40 (FIG. 2) between the top 24 and base 26. The height 40 can vary, but generally will be at least 12 inches. In many situations, the height 40 will be between 15-20 inches, and generally not greater than 40 inches.

Figure 2:
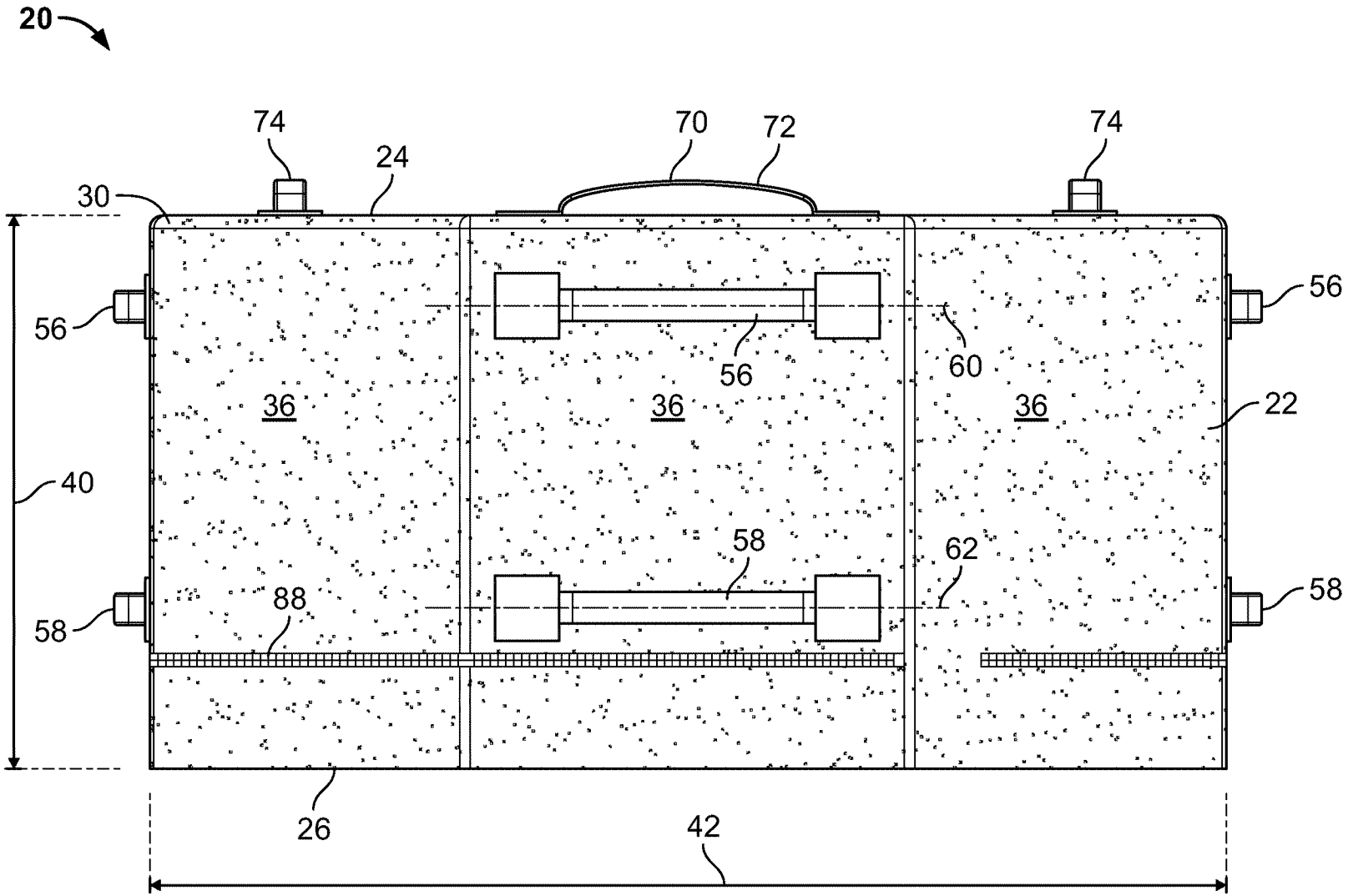
FIG. 2 is a front view of the device of FIG. 1.
Figure 3:
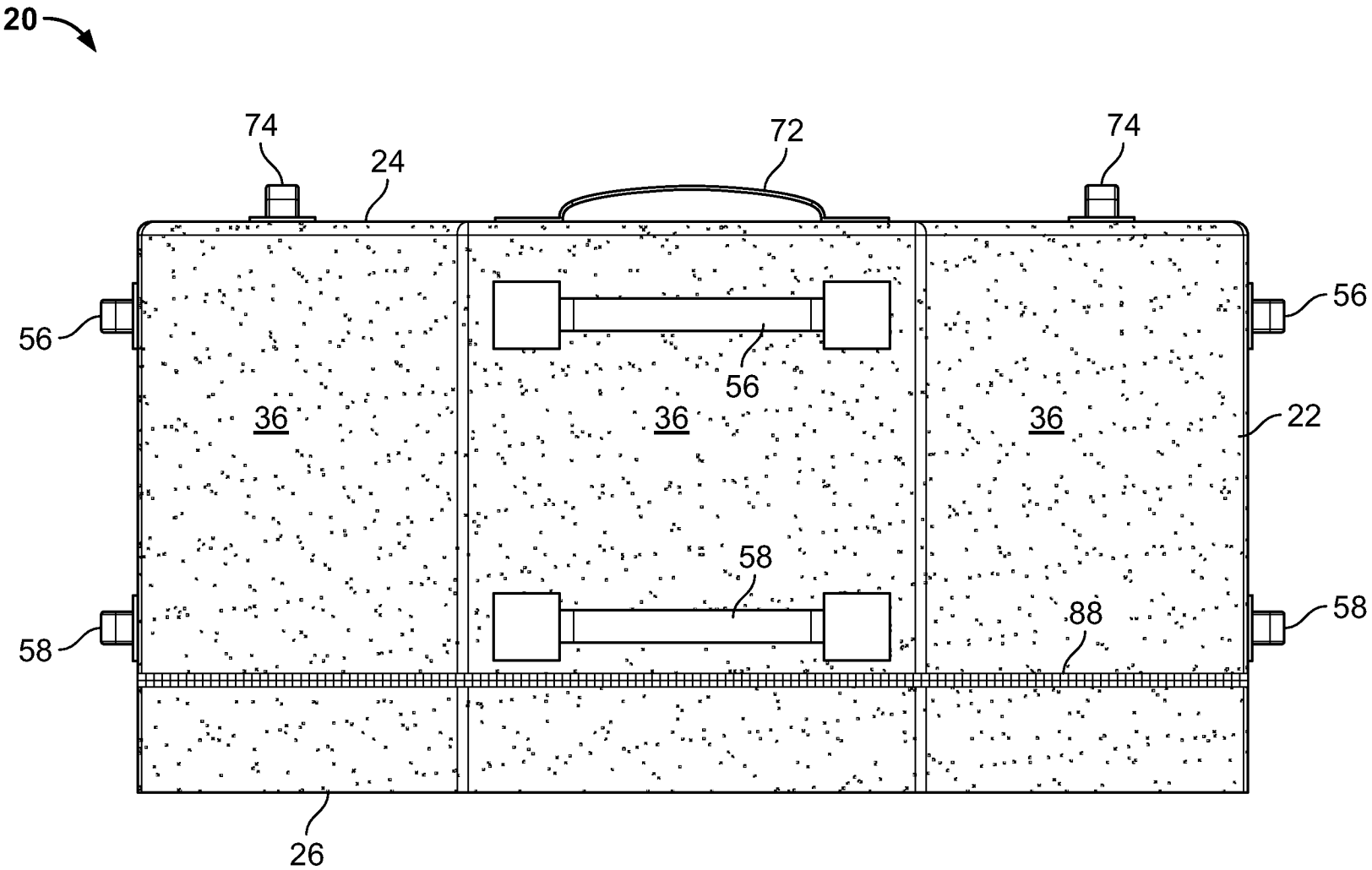
FIG. 3 is a rear view of the device of FIG. 1.
Figure 4:
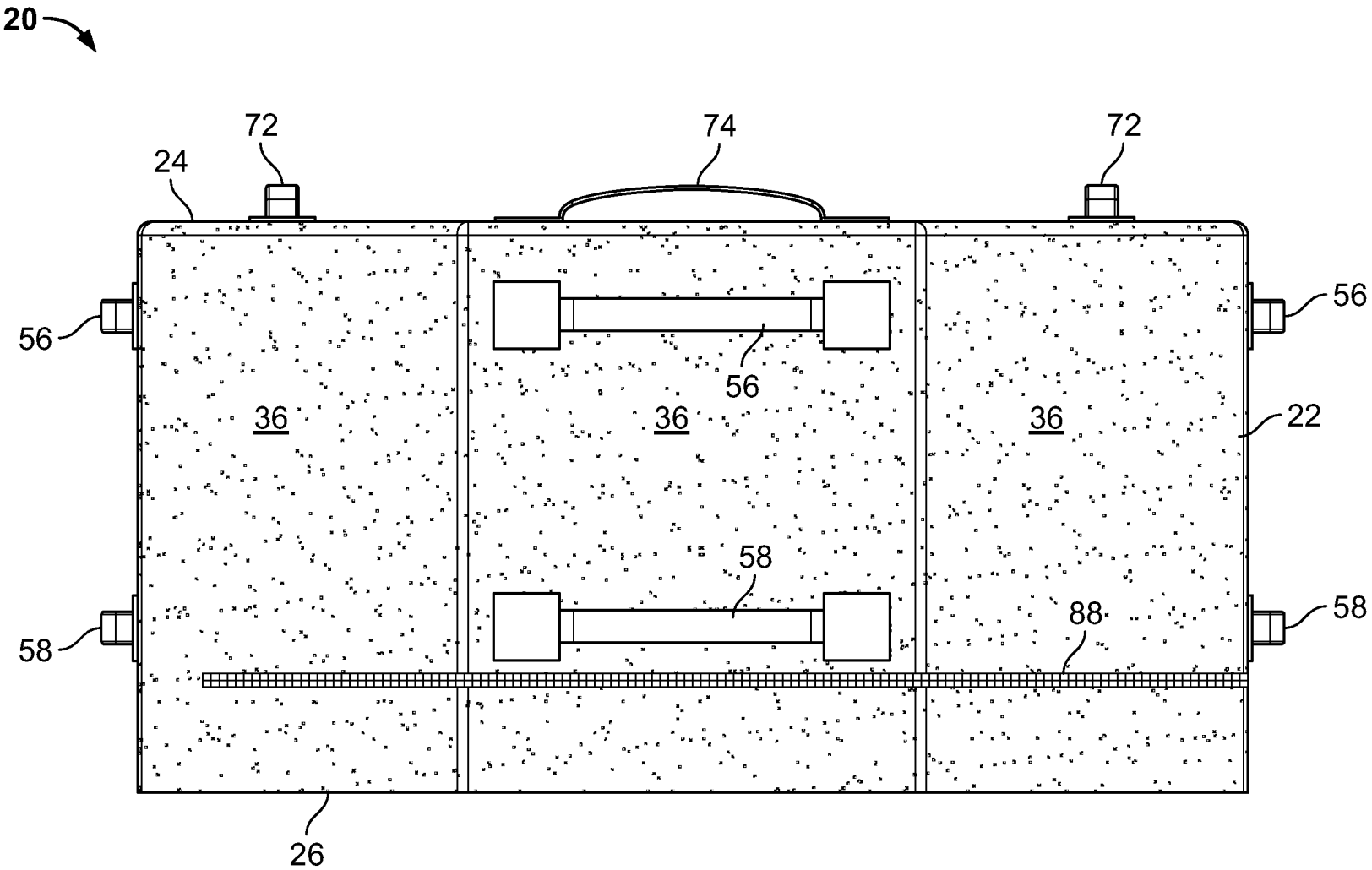
FIG. 4 is a right side view of the device of FIG. 1.
Figure 5:
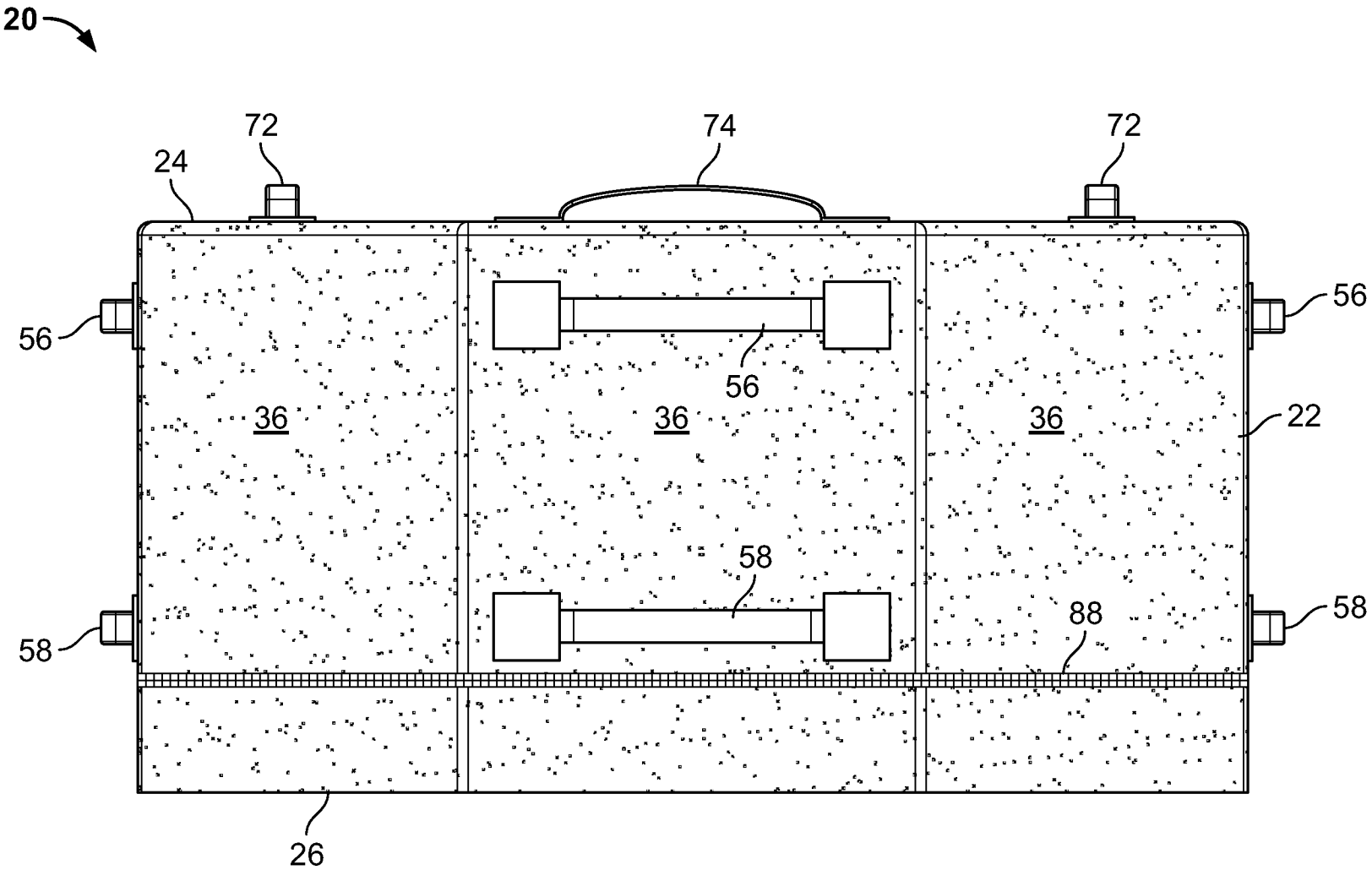
FIG. 5 is a left side view of the device of FIG. 1.

Still in reference to FIG. 2, the body 22 will have a width 42 across the surrounding wall 28, that is a greatest width 42 across the body 22 of generally at least 24 inches. In many embodiments, the width 42 will be 25-55 inches, and generally not greater than 65 inches. Convenient widths 42 include: 27-30 inches; 35-38 inches; 43-46 inches; and 49-52 inches in various embodiments.

Figure 16:
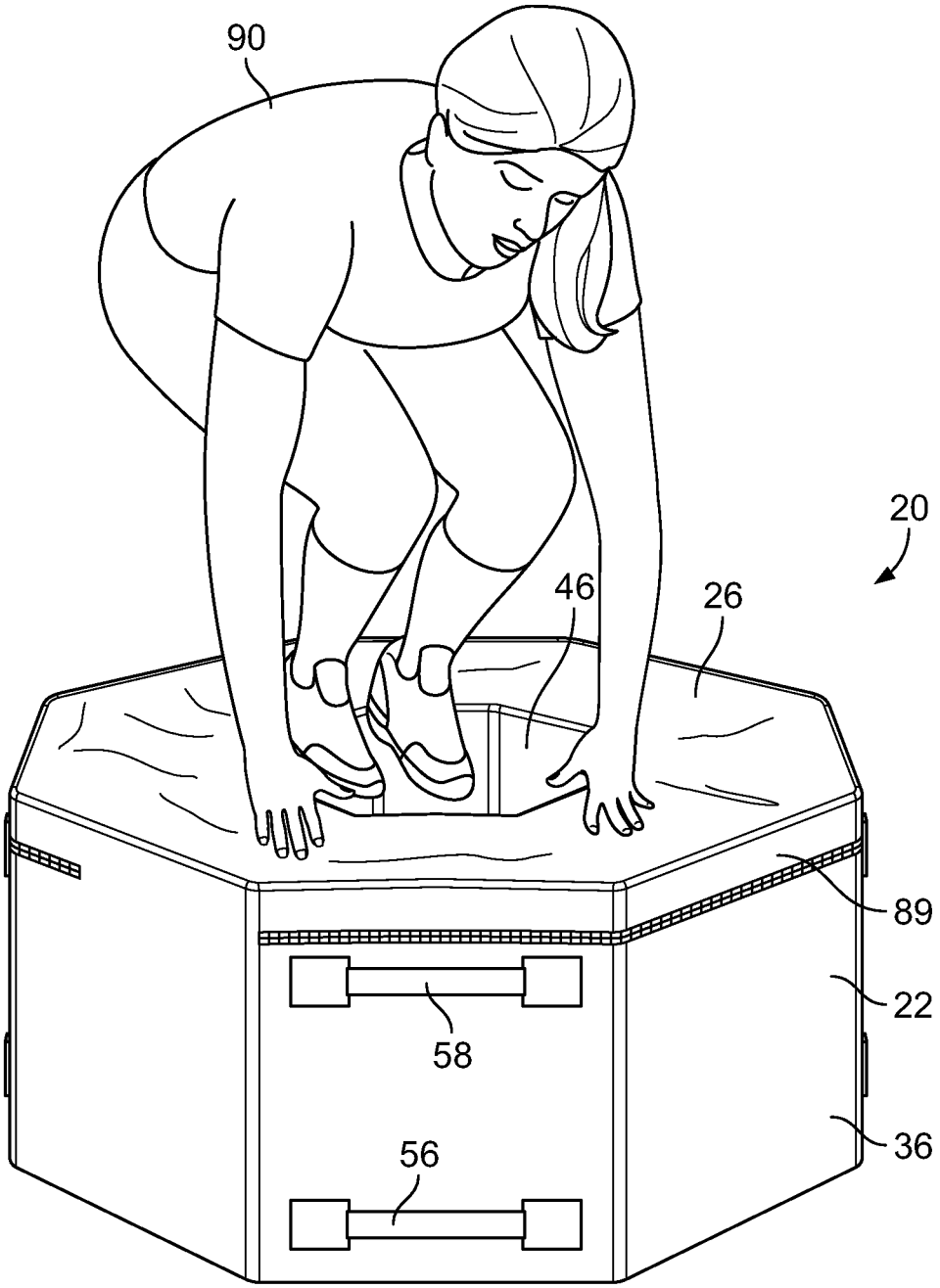
Figure 17:
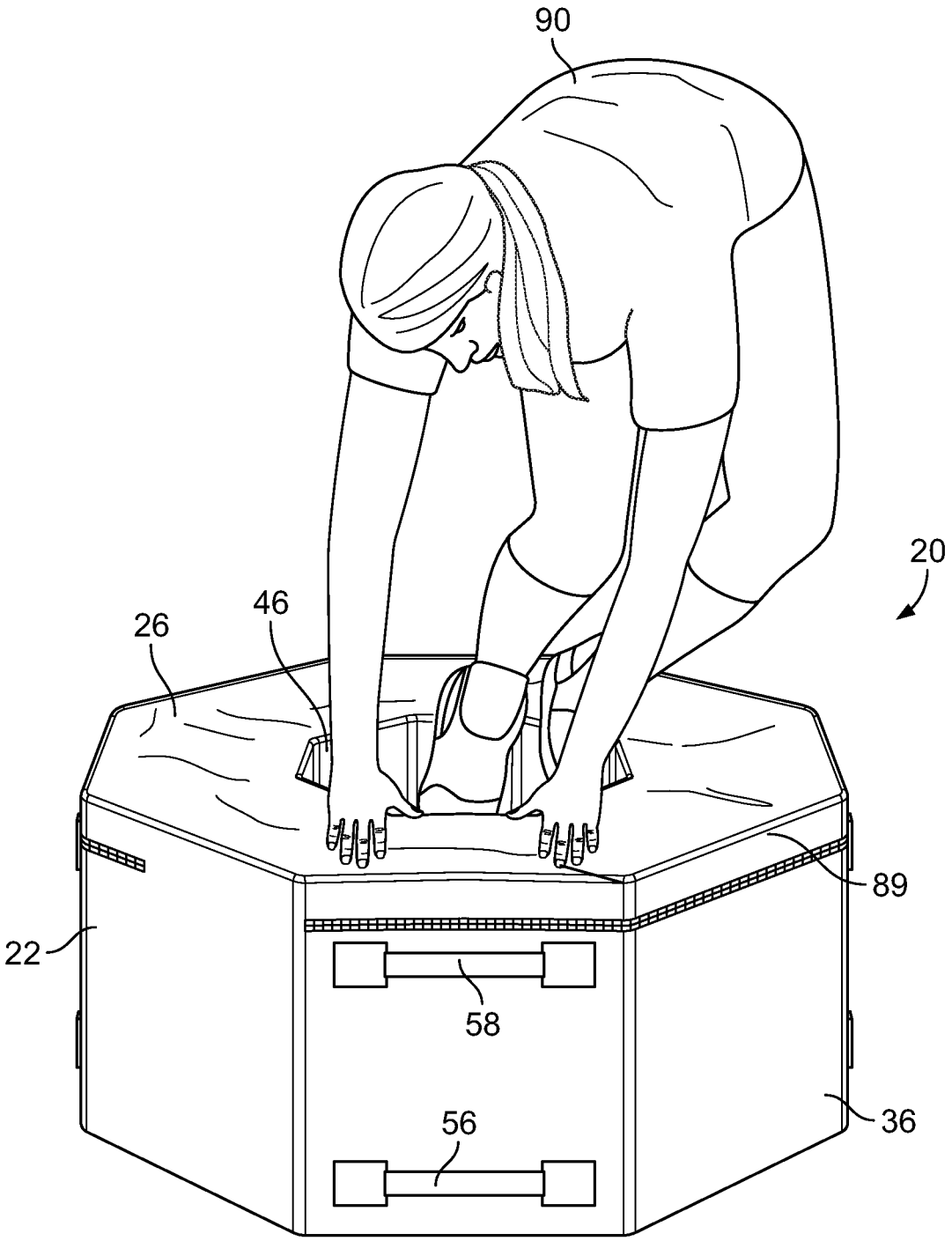

In accordance with principles of this disclosure, the body 22 includes an interior wall 44. The interior wall 44 extends between the top 24 and the base 26. The interior wall 44 surrounds an open interior volume 46. Having the open interior volume 46 leads to advantages in that the training device 20 can be used in training exercises that allow a person to stand within the open interior volume 46. See, for example, FIGS. 13 and 14. In addition, exercises can include jumping into and out of the interior volume 46, such as shown in FIGS. 16 and 17. Many embodiments are possible, and it is contemplated that in other embodiments, the body 22 would not have an interior wall 44 or open interior volume 46, but can be solid. In those embodiments, the training device 20 could be used for exercises such as flipping (FIGS. 9 and 10) or box jumping (FIGS. 11 and 12) but not exercises that require the person to stand in the open interior volume 46.

The interior volume 46 has a largest width 48 (FIG. 6) across it that is preferably large enough to accommodate a normal sized human to stand there within. In many embodiments, the width 48 is at least 9 inches. The width 48 can typically be about 10-30 inches and will generally not be greater than 40 inches. Convenient widths 48 include: 11-12 inches; 17-18 inches; 21-22 inches; and 25-26 inches in various embodiments. Many variations are possible.

The interior wall 44 need not be any particular shape. The interior wall 44 can be rounded or polygon shape. In the particular embodiment shown, the interior wall 44 includes a plurality of sides 50, which can be planar or flat. The interior sides 50 can include any number of sides, but in the embodiment shown, the number of interior sides 50 is equal to the number of sides 36 of the surrounding wall 28. In this embodiment, there are 8 interior sides 50.

Figure 11:
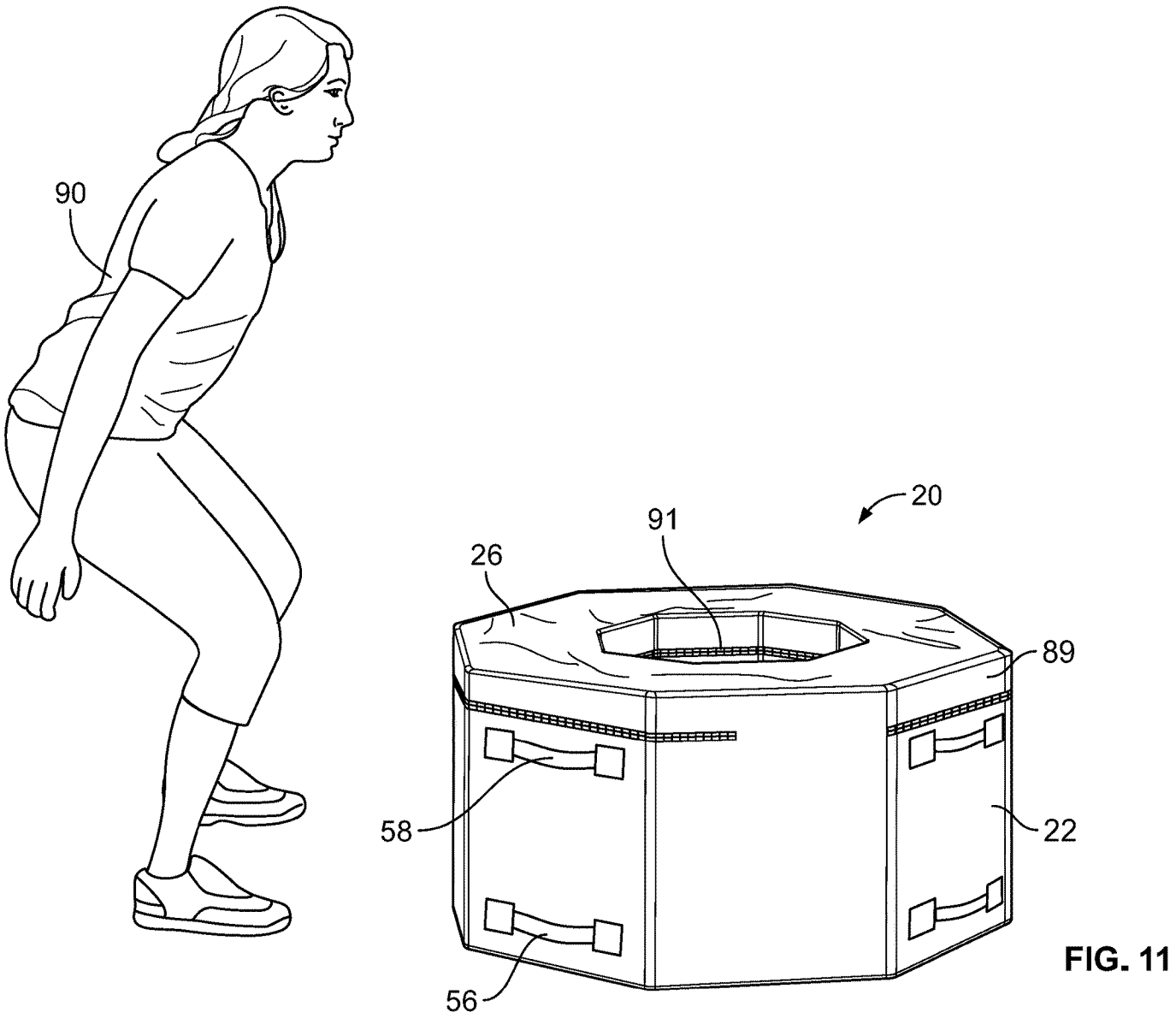
Figure 12:
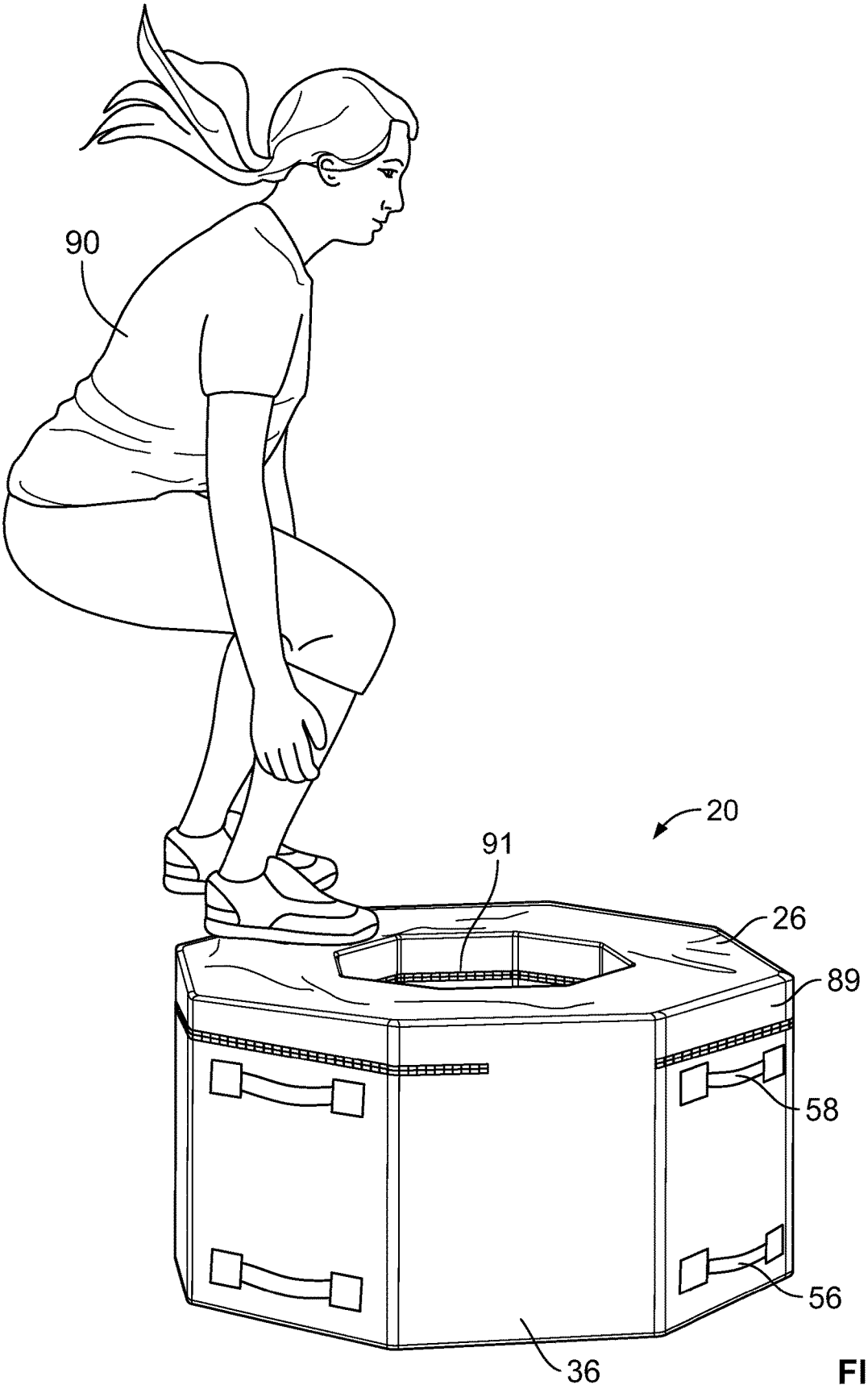

The top 24 and base 26 will generally have a same radial length 52 (FIG. 7) between the surrounding wall 28 and the interior wall 44. The radial length 52 will generally be at least 6 inches, generally 7-15 inches, and typically not greater than 25 inches. It is convenient when the radial length 52 is long enough to support the feet of a normal sized human for training exercises such as box jumping (FIGS. 11-12). Convenient radial lengths 52 include: 8-10 inches; and 11-13 inches in various embodiments.

Figure 13:
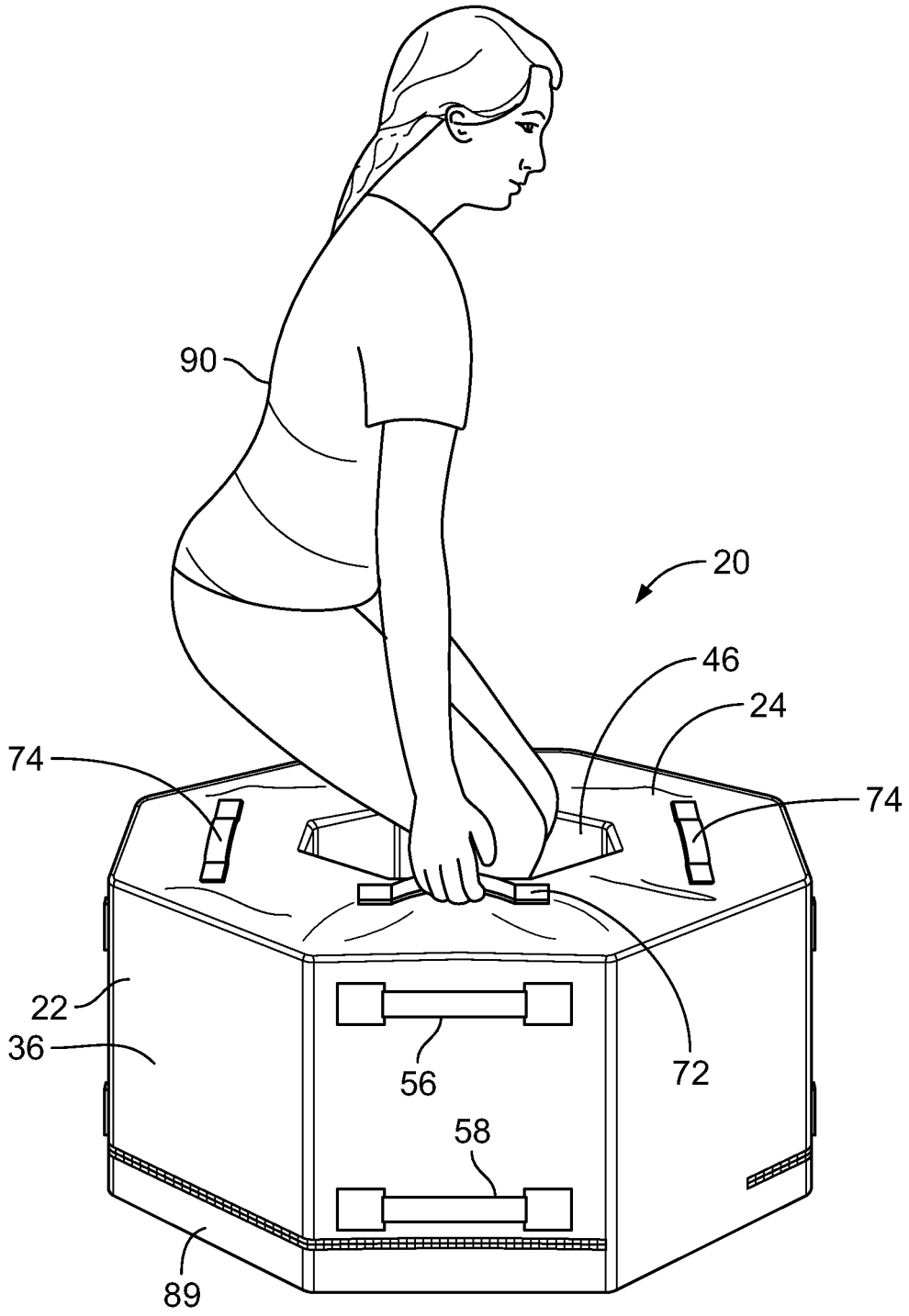
Figure 14:
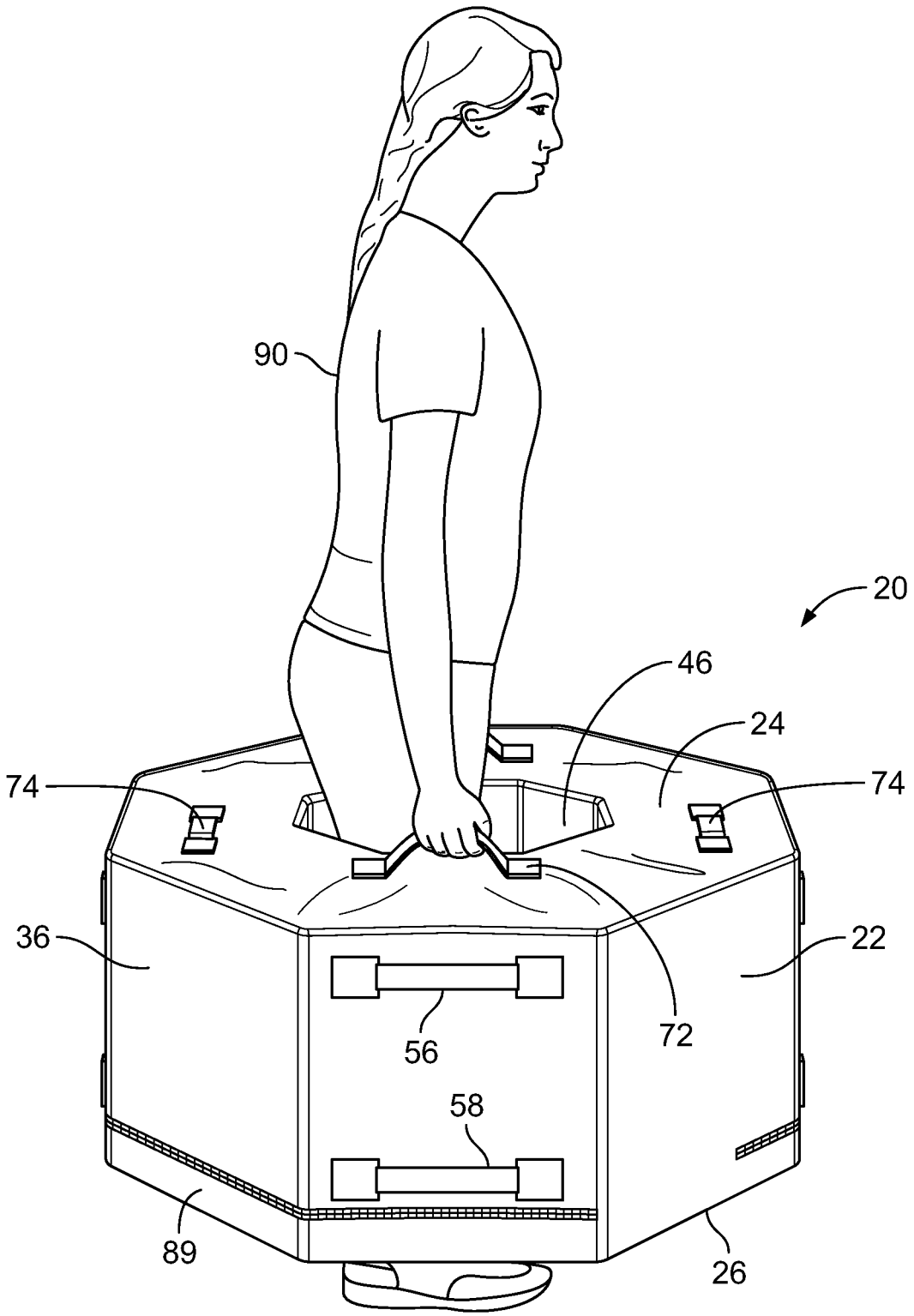

The training device 20 preferably has at least one handle 54. The at least one handle 54 can be extending from at least one of the sides 36 or from the top 24. The handle 54 can be used in training exercises, as depicted in FIGS. 9, 13, and 14.

Many embodiments and arrangements of handles 54 are possible. In the embodiment shown, at least two or more of the sides 36 includes handle 54. In preferred embodiments, at least 2 or more of the sides 36 include a first handle 56 adjacent to the top 24 and a second handle 58 adjacent to the base 26.

The first handle 56 and second handle 58 can be arranged to result in convenient training exercises. For example, in the embodiment shown, the first handle 56 and second handle 58 are generally parallel to each other and to a plane containing the top 24 and the base 26. In other words, an axis 60 running longitudinally along a length of the handle 56 and an axis 62 running longitudinally about the length of the handle 58 (see FIG. 2) will be parallel to a plane containing the top 24 and a plane containing the base 26. The orientation of these handles 56, 58 are helpful in performing the functional training, such as the flipping exercise of FIGS. 9 and 10.

In addition, the location of the first handle 56 adjacent to but spaced from the top 24 and the location of the second handle 58 adjacent to but spaced from the base 26 allows for various forms of flip training. For example, in FIG. 9, a deeper squat can be used by the person due to the lower location of the second handle 58. Once the training device 20 is flipped, so that it is now resting on the top 24, the flip can again be done by grasping the first handle 56, which will be the handle that is lowest and closer to the ground or floor and allow for the deeper squat. If shallower squats are desired, the handle 56, 58 that is higher from the ground can be grasped. The varied locations of the handles 56, 58 allow for variation in training.

As can be seen in FIGS. 1-7, in the particular embodiment illustrated, it is convenient for having alternate sides 36 to have the first and second handles 56, 58 while other alternate sides are handle-free. For example, in FIG. 6, sides 64 include handles 56, 58.

Sides 66 are handle-free. As can be seen, every other side 36 is either handled (sides 64) or handle-free (sides 66).

The at least 1 handle 54 can further include the top 24 having at least 2 top handles 70. The top handles 70 are oriented as extending from the top 24 to allow a training exercise in which the device 20 is grasped along the top handles 20 with a person standing in the interior volume 46 (see FIG. 13). Such an exercise includes the top handles 20 as being on the top 20 with the interior volume 46 therebetween.

In the embodiment illustrated, the top handles 70 include at least 4 top handles 70, illustrated as a first pair of top handles 72 with the open interior volume 46 therebetween and a second pair 74 of top handles with the open volume 46 therebetween.

As can be seen in FIG. 6, the top handles 70 are generally centered between the surrounding wall 28 and the interior wall 44, but variations are possible.

Still in reference to FIG. 6, in the arrangement shown, the top handles 70 are oriented such that a longitudinal axis 76, 78, 80, 82 in alignment along each of the handles 70 does not intercept the open interior volume 46. As illustrated, the first pair of top handles 72 have axes 76, 78 that are generally parallel to each other and parallel to two of the sides 36. The second pair of top handles 74 have axes 80, 82 that are parallel to each other and generally parallel to two of the sides 36. While many variations are possible, in the one shown, the axes 76, 78 are generally perpendicular to the axes 80, 82. This arrangement is convenient in that it allows for a person using the device to be oriented in various angles within the interior volume 46 and perform the lifting and carrying exercises of FIGS. 13 and 14.

In accordance with principles of this disclosure, the training device 20 includes a cover member 86. The cover member 86 covers the body 22 and allows for removal from the body 22 for cleaning or replacement purposes. The cover 86 can be selectively secured to and removed from the body 22 through the use of a fastener arrangement 88. The fastener arrangement 88 can be any type of convenient fastener arrangement, such as a zipper, a hook and loop fastener, snaps, buttons, clasps, ties, etc. The fastener arrangement 88 extends around an outer periphery of the training device 20 less than a full 360°, such as 315-350°. The cover member 86 can also have an inside fastener arrangement 91 (FIGS. 11 and 12), such as a zipper, along the interior wall 44 to help facilitate placement and removal of the cover member 86 relative to the body 22. In preferred arrangements, the inside fastener arrangement 91 along the interior wall 44 extends a full 360°. As can be seen in FIGS. 11 and 12, the fastener arrangement 88 and the inside fastener arrangement 91 can be adjacent to a same end, in this case base 26. This arrangement allows for convenient placing of the cover member 86 over the body 22. Other embodiments are possible.

The cover member 86 is preferably made from a durable material that is easily cleanable. For example, the cover member 86 can be vinyl or other type of material that is easily cleanable and durable. The fastener arrangement 88 can be covered with a flap or strip of the cover material, and can be a flap tightly covering the fastener arrangement 88 or it can be securable to a remaining portion of the cover member 86 with, for example, a hook and loop fastener arrangement or other types of fastener arrangements. In FIGS. 9-18, the fastener arrangement 88 is covered with a removable flap or strip 89 to cover and protect an underlying zipper. The flap or strip 89 helps enhances the aesthetic appearance of the training device 20, while also reinforcing the zipper by not exposing it to the elements. The at least one handle 54, including handles 56, 58 on the sides 64 and handles 70 on the top 24 are preferably secured to the exterior of the cover member 86. It is contemplated that the cover member 86 can include handles 54 in different orientations, in case it is desired to change out the type of training exercises done, which might require handles in a different orientation.

As can be seen in FIG. 7, in preferred embodiments, the base 26 is handle-free. Having the base 26 be handle-free allows the base 26 to be free of obstructions to allow for box jumping (FIGS. 11 and 12) without interference between a person's foot and a handle.

Reference is now made to the examples of use of the training device 20 shown in FIGS. 9-18.

FIGS. 9 and 10 show a flipping exercise. In FIGS. 9 and 10, the person 90 will squat down and select any two handles or slid their hands under the device 20 until a comfortable and firm grip is developed. FIG. 9 illustrates the person 90 grasping the second handles 58 that are adjacent to the base 26. The person 90 keeps her shoulders back, chest up, and back flat and drives up from the heels to use their legs to lift the body 22 on its side 36. The body 22 is let go and then pushed over (FIG. 10) to land on the opposite top 24 or base 26 from where it started. In FIG. 9, the body 22 was initially on the base 26 and is flipped to then rest on the top 24. This exercise can be continued for a desired number of repetitions.

FIGS. 11 and 12 illustrate a box jump or a plyo jump. The body 22 is placed on its top 24 such that the handle-free base 26 is facing upward. The person 90 squats down, takes arms back to use forward momentum, and jumps up and forward to land onto the base 26 of the body 22 on both feet with knees slightly bent (FIG. 12). The person 90 dismounts by stepping backwards, and this can be continued for a desired number of repetitions or for a predetermined amount of time.

FIGS. 13 and 14 illustrate a farmer's carry exercise. The training device 20 is started with the base 26 on the ground and the top 24 facing upwardly. The person 90 steps into the interior volume 46, squats down, and firmly grasps one of the top handles 70 on each side. That is, the person 90 will grasp either the first pair 72 or the second pair 74. Keeping shoulders back, chest up, back flat, and arms nearly straight, the person 90 uses legs to lift the body 22 until suspended. See FIG. 14. The person 90 will then walk forward while carrying the body 22 for a predetermined number of steps, distance, or time. The person 90 will stop with the weight on her heels, slowly bend her knees, and lower the body 22 back to the floor. This is continued for a desired number of repetitions or for a predetermined amount of time.

Figure 15:
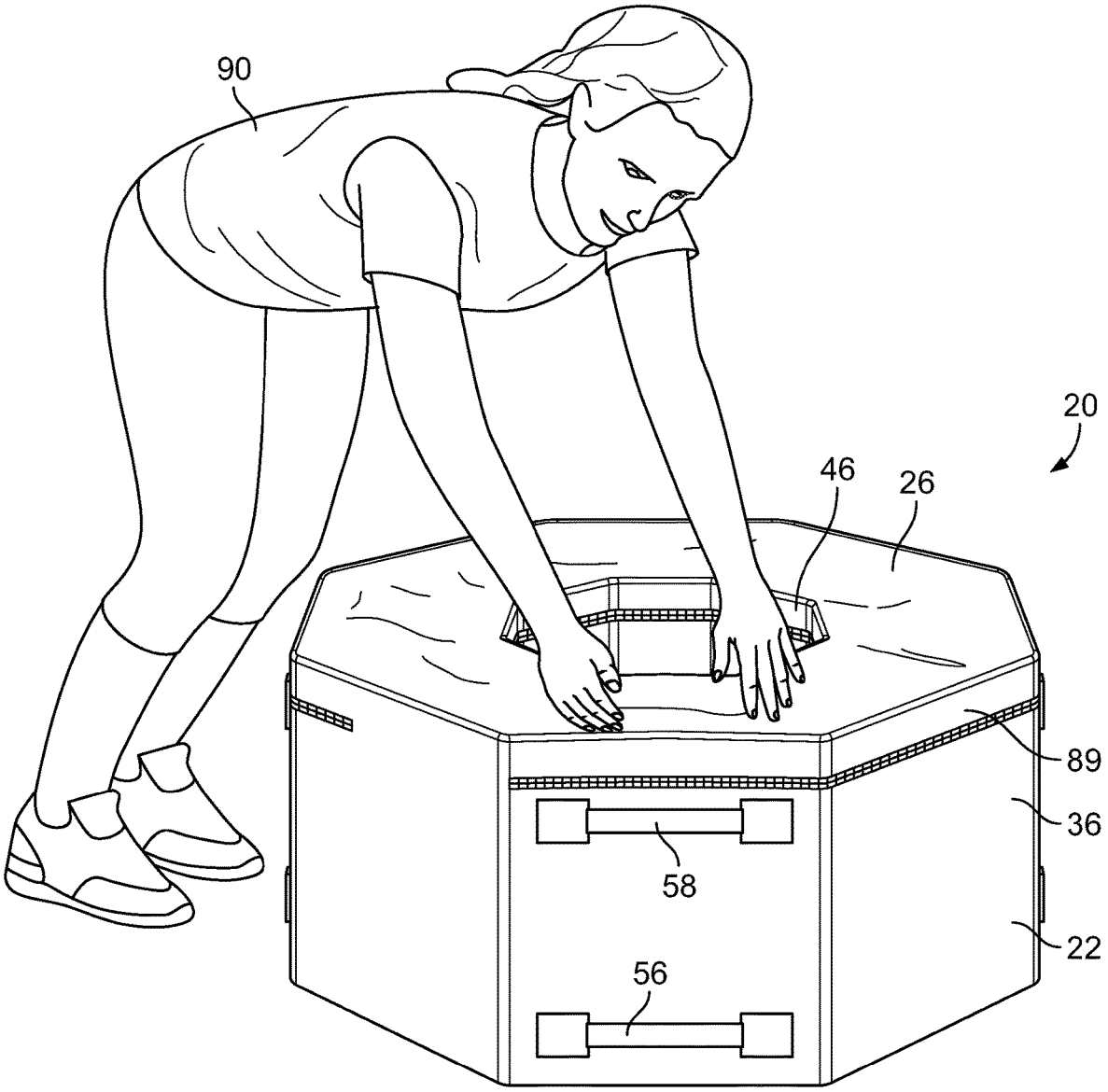
Figure 18:
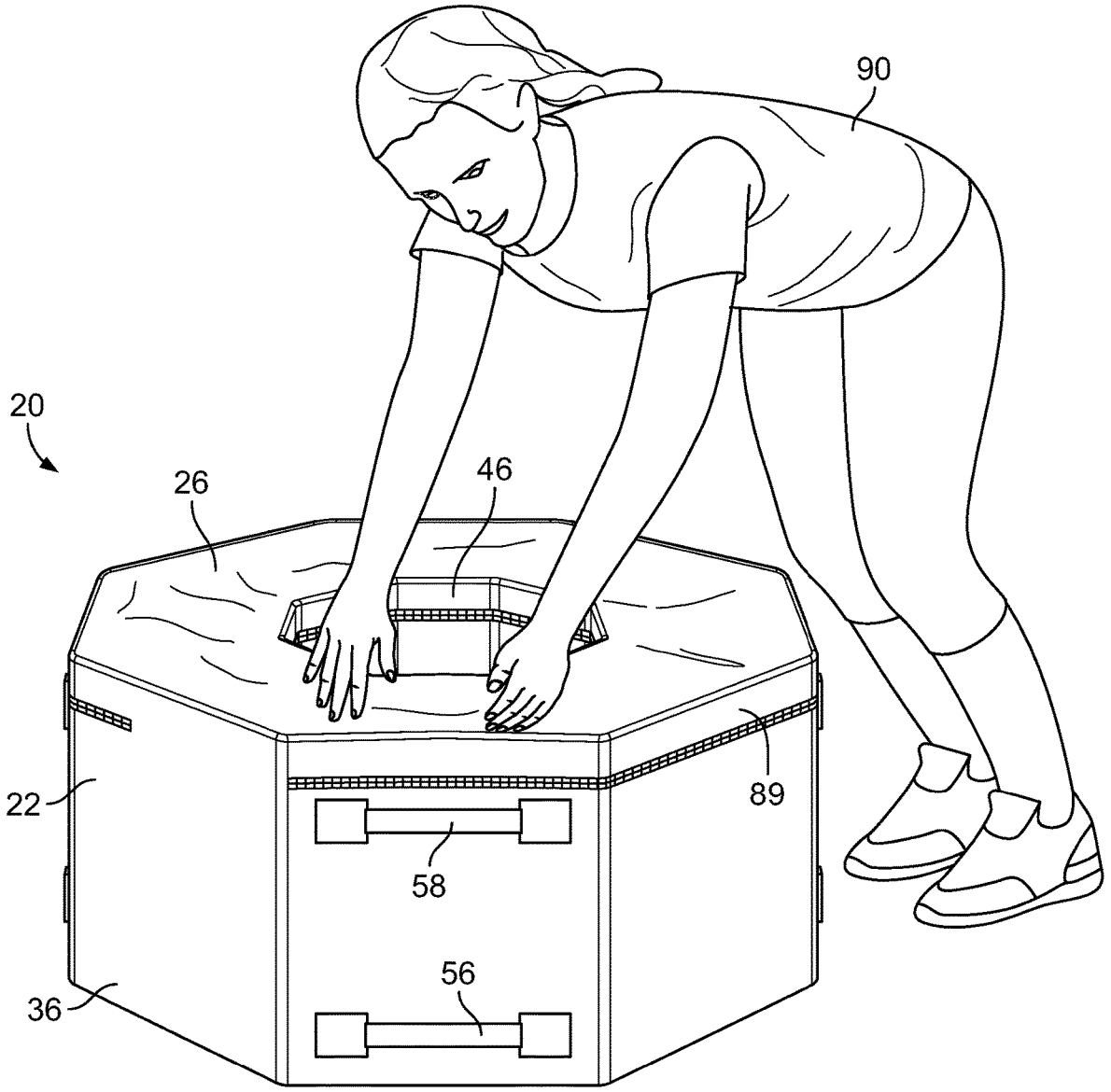

FIGS. 15-18 illustrate a hop-in-and-over exercise (e.g., side jumps). In FIG. 15, the person 90 stands to one side of the body 22, places her palms flat on the front middle edge of the body 22 and then jumps with feet together into the open interior volume 46 (FIG. 16). The person 90 then pauses and jumps again with both feet the opposite side of the body 22 (FIGS. 17 and 18). This process is repeated by jumping back to the side that the person 90 started on in FIG. 15. This can be continued for a desired number of repetitions or for a predetermined amount of time.

The above incorporates example principles. Many embodiments can be made using these principles.

What is claimed is:

1. A method of using an athletic tire training device comprising:

(a) grasping a compressible body weighing at least 20 pounds; the body having a flat surfaced top, a flat surfaced base, a surrounding wall extending between the top and base, and an interior wall extending between the top and base; the interior wall surrounding an open interior volume; and (b) moving the body from a position resting on either the top or base to a position resting on one of a plurality of flat sides that forms part of the surrounding wall.

2. The method of claim 1 wherein grasping the compressible body includes grasping the body having a height between the top and base of at least 12 inches and a width across the surrounding wall of at least 24 inches, and the interior volume having a width of at least 9 inches.

3. The method of claim 1 wherein grasping the compressible body includes grasping a handle on at least one of the flat sides.

4. The method of claim 1 wherein grasping the compressible body includes grasping a handle on the flat surfaced top.

5. The method of claim 4 wherein grasping the handle on the flat surfaced top includes grasping two handles on the flat surfaced top.

6. The method of claim 5 further including:

(a) moving the body to a position in which the flat surfaced base is facing downward and the flat surfaced top is facing upward;

(b) stepping in the open interior volume;

(c) grasping the two handles on the flat surfaced top; and (d) lifting the body.

7. The method of claim 1 wherein grasping the compressible body includes grasping the body with the base being handle-free.

8. The method of claim 7 further including:

(a) moving the body to a position in which the handle-free base is facing upward and the flat surfaced top is facing downward; and (b) jumping onto the handle-free base.

9. The method of claim 1 wherein grasping the compressible body includes grasping the body having a cover member covering the body.

10. The method of claim 9, wherein grasping the compressible body includes grasping a handle on one of the flat sides and on the flat surfaced top, each handle being secured to an exterior of the cover member.

11. The method of claim 1 wherein grasping the compressible body includes grasping the body consisting essentially of a single material.

12. The method of claim 1 wherein grasping the compressible body includes grasping the body consisting essentially of a polyurethane foam blend.

13. The method of claim 1 wherein grasping the compressible body includes grasping the body having a weight of at least 50 pounds.

14. The method of claim 1 wherein grasping the compressible body includes grasping the body having a weight of at least 90 pounds.

15. The method of claim 1 wherein grasping the compressible body includes grasping the body having a weight of at least 200 pounds.

* * * * *